United States Patent [19]

Sickles et al.

[11] 4,440,349

[45] Apr. 3, 1984

[54] ELECTROSTATIC SPRAY GUN HAVING INCREASED SURFACE AREA FROM WHICH FLUID PARTICLES CAN BE FORMED

[75] Inventors: James E. Sickles, Glenshaw, Pa.; Themistocles C. Anestos, Utica, Mich.

[73] Assignee: PPG Industries, Inc., Pittsburgh, Pa.

[21] Appl. No.: 76,014

[22] Filed: Sep. 17, 1979

[51] Int. Cl.[3] ..... B05B 5/02

[52] U.S. Cl. ..... 239/698; 239/705; 239/708

[58] Field of Search ..... 239/3, 690–708, 239/456, 505, 506, 518, 524; 361/228

[56] References Cited

U.S. PATENT DOCUMENTS

| | | | |
|---|---|---|---|
| 2,302,185 | 11/1942 | Campbell, Jr. | 239/707 |
| 3,498,540 | 3/1970 | Adams | 239/698 |
| 3,521,815 | 7/1970 | Szasz | 239/698 |
| 4,009,829 | 3/1977 | Sickles | 239/705 |
| 4,106,697 | 8/1978 | Sickles et al. | 239/705 |

FOREIGN PATENT DOCUMENTS

| | | | |
|---|---|---|---|
| 178366 | 7/1935 | Switzerland | 239/456 |
| 336173 | 10/1930 | United Kingdom | 239/456 |
| 1507561 | 4/1978 | United Kingdom . | |
| 1507562 | 4/1978 | United Kingdom . | |

*Primary Examiner*—Andres Kashnikow

*Attorney, Agent, or Firm*—Godfried R. Akorli; George D. Morris

[57] ABSTRACT

Disclosed is a spray gun having a gas nozzle and a fluid nozzle, each of said nozzles being in cooperative spatial relationship with the other to cause a fluid stream issuing from the fluid nozzle to be atomized and sprayed as fluid particles by gas issuing from the gas nozzle. In a preferred embodiment the fluid nozzle orifice has therein an axially disposed rod to increase surface area from which said fluid particles can be formed, said rod being electrically grounded at least during fluid issue from the nozzle. The spray gun additionally has an induction charging electrode disposed adjacent the gas and fluid nozzles, said electrode defining a charging zone wherein an electrostatic charge is imparted to atomized electrically-chargeable fluid particles.

11 Claims, 8 Drawing Figures

FIG. 1
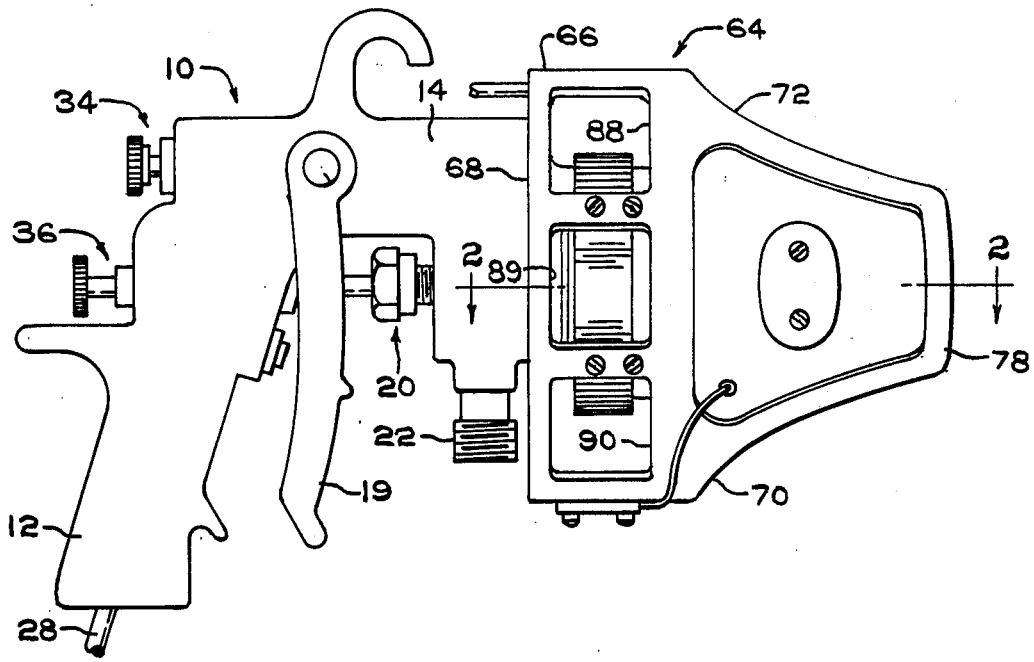
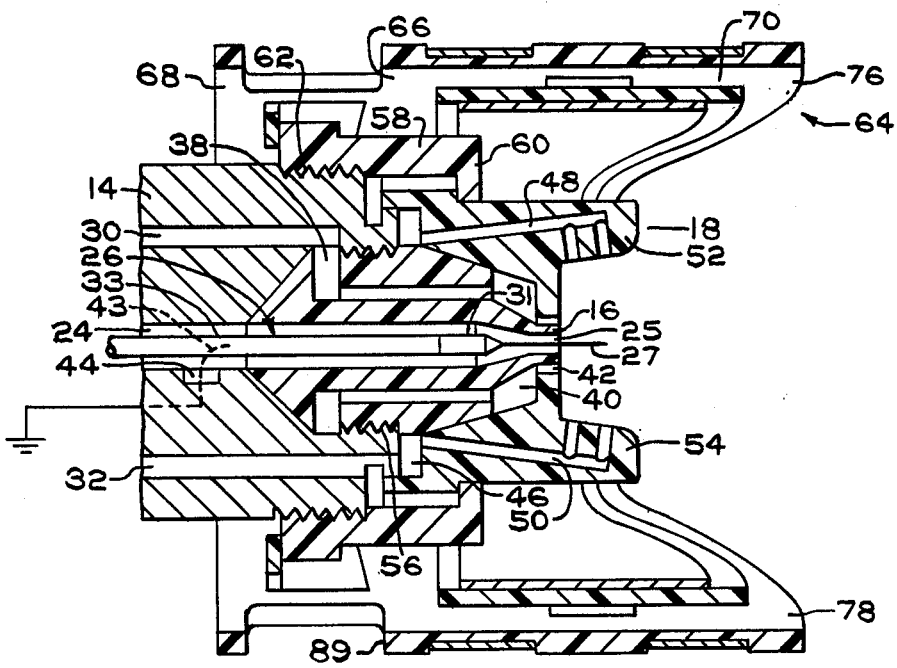
FIG. 2

ELECTROSTATIC SPRAY GUN HAVING INCREASED SURFACE AREA FROM WHICH FLUID PARTICLES CAN BE FORMED

BACKGROUND OF THE INVENTION

Gas atomization of a fluid such as a paint composition to break up the fluid into particles for subsequent application to a workpiece to be coated is a technique well recognized in the art. Spray apparatus generally employed is a spray gun to which is supplied a fluid stream and a gas stream. The gas is most usually air, but can, of course, be chosen from other gases as required. The fluid stream issues from the spray gun via a fluid nozzle while the gas stream issues via a gas nozzle, with the gas stream intersecting or otherwise disturbing the fluid stream to provide atomized sprayed fluid particles.

To improve coating characteristics of the fluid particles issuing from the spray gun, various techniques have been developed to electrostatically impart an electrical charge to these particles prior to their arrival on the workpiece to be coated. One such technique is induction charging. Briefly, and in relation to the instant invention, a method of inducing an electrical charge on sprayed fluid particles involves the placement of an induction charging electrode means adjacent the fluid and gas nozzles. This electrode means induces an electrical charge on the atomized fluid particles, which charge is opposite to the electrode's charge, as the particles pass within a charging zone created between the electrode means and the particle stream. The electrode means itself can be an integral fixture of the spray gun, or it can be removably connected to the spray gun. An example of the latter electrode means which can be fitted to a conventional spray gun is described in U.S. Pat. No. 4,009,829, to James E. Sickles, incorporated herein by reference.

It has been observed that some paint compositions have a strong tendency to break up unevenly when gas atomized. One example of such a group of paint compositions are the acrylic water-thinned automotive topcoat compositions. When such compositions are gas atomized, a group of large fluid particles (50–100+ microns) is formed while many fines (<10 microns) are also produced. It has also been observed that induction charging tends to produce even more fines and to preferentially charge these fines while leaving the larger particles substantially uncharged. Since most of the paint mass is contained in the large particles, the expected benefits of electrostatic charging, such as increased transfer efficiency at the workpiece, are substantially reduced.

One object of the instant invention is, therefore, to provide an electrostatic spray gun that imparts a more completely charged fluid particle stream for subsequent application to the workpiece. Another object of the instant invention is to provide a charged fluid particle stream wherein the particles are more uniformly sized. These and other objects will become apparent within the body of this application.

SUMMARY OF THE INVENTION

The subject of the invention disclosed and claimed herein is a spray gun having a gas nozzle and a fluid nozzle, each of said nozzles being in cooperative spatial relationship with the outer to cause a fluid stream issuing from the fluid nozzle to be atomized and sprayed as fluid particles by gas issuing from the gas nozzle, with said spray gun having disposed within the fluid stream means for increasing surface area from which said particles can be formed, said means being electrically grounded at least during fluid issue from the fluid nozzle, and with said spray gun additionally having induction charging electrode means disposed adjacent the gas and fluid nozzles, said electrode means (a) having a rear edge located rearward of a plane which is perpendicular to the axis of liquid flow and which passes through the discharge point of the fluid nozzle and (b) defining a charging zone wherein an electrostatic charge is imparted to atomized electrically chargeable fluid particles. By providing the surface area increasing means, forming fluid particles are afforded greater exposure to the electrostatic field. In a preferred embodiment, the means for increasing surface area comprises an axially disposed rod within the orifice of the fluid nozzle and protruding forwardly therefrom. Examples of other surface area increasing means include one or more tubes, one or more screw-thread rods, multiple rods, one or more rods with various geometries such as an inverse cone or pointed tip disposed distally, and the like. The means can be disposed within the fluid nozzle orifice, or can be otherwise mounted so long as said means resides within the fluid stream.

As recited above, the surface area increasing means must be electrically grounded at least during fluid issue from the fluid nozzle orifice. The means can be electrically conductive, in which case construction can be of a conductive plastic, metal, or the like. Grounding can be accomplished by direct ground connection, or it can be accomplished through the fluid to be sprayed. The means also can be electrically non-conductive or dielectric in nature, in which case construction can be of an acetal resin, an epoxy resin, a glass-filled epoxy resin, a glass-filled nylon, or the like. When the material comprising the means is electrically non-conductive or dielectric, an electrically-conductive grounded means is, in fact, created when the spray gun is in operation and the means becomes coated with electrically conductive fluid after issue of said fluid from the fluid nozzle orifice. In this embodiment, grounding is accomplished through the fluid to be sprayed. When the fluid supplied to the spray gun is discontinued, electrically non-conductive or dielectric properties of the means are again manifested as the electrically conductive fluid which coats the means is swept away by the atomizing gas. Utilization of an electrically non-conductive or dielectric means prevents the possibility of arcing or sparking between the rod and the induction electrode means. Alternatively, the surface area increasing means can be constructed of a combination of conductive and non-conductive materials as, for example, a rod whose tip portion is electrically conductive, but whose remaining portion is electrically non-conductive or dielectric. In such a configuration, the non-conductive or dielectric portion can be made to seat within the fluid nozzle orifice when fluid issue therefrom is stopped, thereby inhibiting arcing or sparking between the tip of the rod and the electrode means.

When grounding is accomplished through the fluid to be sprayed, it is, of course, necessary that the fluid be electrically conductive irrespective of whether the surface area increasing means is electrically conductive. Because the induction charging principle is included in the invention, electrical conductivity of the fluid is prima facie, since a fluid which is not electrically conductive, and therefore substantially incapable of being inductively charged, would find little benefit in an induction charging system.

The induction charging electrode means can be an integral fixture of the spray gun or it can be removably connected to said spray gun. Because the surface area increasing means is electrically grounded at least during fluid issue from the fluid nozzle, the fluid in contact with the means is very near ground potential, thus providing for any given applied voltage a maximum potential gradient between the electrode means and the fluid surface being atomized into particles to thereby produce maximum particle charging. Furthermore, it is found that the surface area increasing means acts to provide more surface area from which particles can be formed, resulting in formation of a greater number of more uniformly-sized charged particles under the combined action of the shearing atomization air and the applied electric field. This is due in part to decreased average shear on the particles since issue of the atomization air from the gas nozzle is upstream from the surface area increasing means. The maximum potential gradient discussed above, coupled with the greater tendency to produce uniformly-sized particles, also act to distribute the electrical charge more evenly on the particles and thereby yield better deposition of fluid particles on the workpiece being coated, said workpiece being understood to be electrically receptive to the charged spray. In such manner, a more completely charged and more uniformly sized fluid particle stream is provided.

Although the invention is described and exemplified more fully in the following description and accompanying drawings, it is to be understood that this description and these drawings are not intended to limit the scope of the invention, but rather that the invention shall be defined as set forth in the appended claims.

BRIEF DESCRIPTION OF THE DRAWINGS

FIG. 1 is a side elevation view of a spray gun, shown in diagrammatic form, to which is connected an adapter bearing induction charging electrode means;

FIG. 2 is a partial sectional view of the spray gun and induction charging electrode means taken along line 2—2 of FIG. 1, additionally showing the needle of a needle valve assembly and a coaxially disposed rod within the orifice of the fluid nozzle;

DESCRIPTION OF PREFERRED EMBODIMENTS

Figure 3:
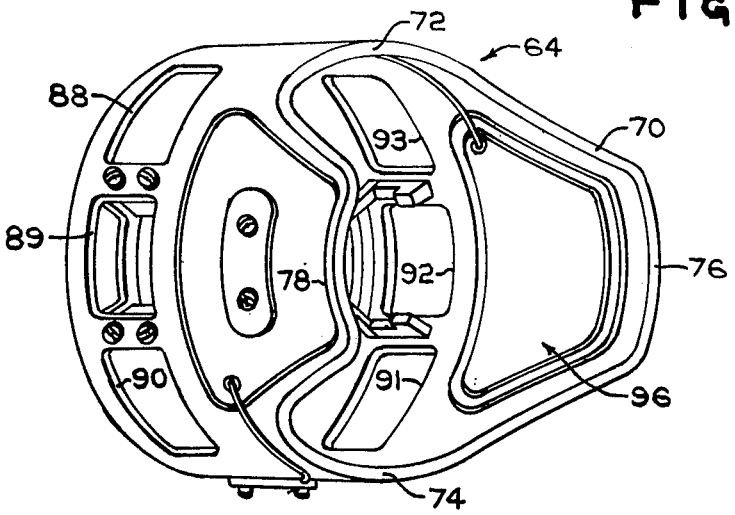
FIG. 3 is a perspective view of the adapter of FIG. 1.

Referring to FIGS. 1 and 2 of the drawings, a conventional hand-held, air-operated spray gun 10 is illustrated, said spray gun 10 having a handle portion 12, a barrel 14, a fluid nozzle 16 and a gas (air) nozzle 18, the latter two elements shown in FIG. 2. The spray gun 10 has a conventional trigger mechanism 19 which operates valve means 20 comprising a needle valve assembly to admit fluid from a supply source (not shown) to the spray gun 10. The fluid is fed to the spray gun 10 through a suitable connector 22 threadably connectable to a corresponding connector on a fluid feed hose (not shown) from the fluid supply. The fluid to be sprayed passes through the valve means 20 and flows through a fluid passageway 24 to the orifice 25 of the fluid nozzle 16. The needle 26 of the needle valve assembly moves axially in concert with movement of the trigger mechanism 19 to control fluid flow through the fluid nozzle orifice 25. In the embodiment shown in FIG. 2, a rod 27 extends forwardly from the tip of the needle 26 to be axially disposed within the fluid nozzle orifice 25 and protrudes forwardly from said fluid nozzle orifice 25.

Air or another suitable gas is applied under pressure to the gas nozzle 18 by way of an air hose 28 and through suitable passageways in the body of the spray gun 10. The gas supply is divided into two separate passageways 30 and 32, with gas flow being regulated by a manually adjustable control valve generally indicated at 34. A second control valve 36 permits adjustment of the needle 26 in passageway 24, in a manner as known in the art. The gas flow in one of the passageways, for example passageway 30, is directed to an annular chamber 38 from which the gas flows forward to a second annular chamber 40. The gas nozzle 18 incorporates a plurality of orifices such as an annulus 42 surrounding the fluid nozzle orifice 25, which serve to direct gas from chamber 40 to shape the flow of fluid from the fluid nozzle orifice 25 in known manner. The flow of gas from passageway 32 is directed to an annular chamber 46 which is in communication with passageways 48 and 50 leading to orifices disposed in diametrically opposed ears 52 and 54 of the gas nozzle 18. Gas flowing from the orifices in the ears 52 and 54 serve to direct gas toward the atomized fluid being discharged from fluid nozzle orifice 25 and thereby shape the pattern of the spray.

In the instant embodiment the fluid nozzle 16 is preferably constructed of metal, and is grounded through the fluid sprayed. Said nozzle 16 can also be grounded directly, or can be constructed of an electrically non-conductive or dielectric material. The gas nozzle 18 is constructed of an electrically non-conductive or dielectric material. The fluid nozzle 16 can be secured in the barrel 14 of the spray gun 10 by any suitable means, as by threads 56. Similarly, the gas nozzle 18 is secured to the barrel 14 by suitable means such as an annular nut 58 having an inner shoulder portion 60 which engages a corresponding shoulder on the gas nozzle 18 and which is threaded onto the exterior of the barrel 14 by means of threads 62. Fluid being supplied is electrically grounded, as by means of a ground plate 44, in order to insure proper induction charging.

Mounted on the exterior of the barrel 14 and concentric with the fluid nozzle orifice 25 is an induction charging adapter 64 bearing induction charging electrode means. U.S. Pat. No. 4,009,829, to James E. Sickles, fully describes the adapter 64, and said patent is included herein and made a part hereof by reference. As described and exemplified as a preferred embodiment in said patent and as illustrated in FIGS. 1 and 3 hereof, the adapter is essentially a cylindrical housing 66 formed of a dielectric material and having a rearward portion 68 adapted to be secured to the spray gun and a forwardly extending portion 70 adapted to surround the path of the discharged spray material. Diametrically opposed portions of the forward part of the dielectric housing 66 are cut away at 72 and 74 (See FIG. 3), leaving shaped, forwardly extending, opposed lobes 76 and 78 remaining. The lobes 76 and 78 carry charging electrodes, for which a d.c. voltage is applied for inductively charging the spray particles, while the cutaway portions 72 and 74 prevent interference by the housing 66 with generally fanshaped patterns which may be produced in the spray, and assist in the aspiration of ambient air through the housing 66. Again, it will be understood that the dielectric housing may be constructed of any suitable material capable of withstanding the high voltages used, and in particular can be constructed of materials including acetal resins, epoxy resins, glass-filled epoxy resins, or the like. The adapter 64 is attached to the end of spray gun 10 by means of suitable mounts which are shaped to engage the outer surface of the barrel or of the annular nut 58. Although the exact shape of the mounts will depend upon the construction of the particular barrel to which the adapter is to be connected, the mounts in general are formed to secure the adapter in concentric relationship with the fluid nozzle orifice 25. Again, reference should be made to U.S. Pat. No. 4,009,829 in regard to mounting configurations.

The electrostatic field by means of which the adapter 64 produces induction charging of the atomized fluid particles is generated by means of a pair of charging electrodes 96 and 98. These electrodes are mounted to the inner surfaces of lobes 76 and 78, respectively, of the adapter and thus are positioned on diametrically opposite sides of the fluid and air nozzles. The electrodes are spaced from the fluid nozzle and are concentric therewith, having curved surfaces which are equidistant from the longitudinal axis of the fluid nozzle 16. A high positive or negative voltage is supplied to the two opposed electrodes 96 and 98, and this voltage produces an electrostatic field between the electrodes and the electrically grounded fluid atomized and discharged from the spray gun. This field defines a charging zone within the adapter which serves to induce an opposite charge on any particulate fluids formed therein. The voltage can vary over a wide range, but preferably is less than about 25 kilovolts. The magnitude of the voltage required to achieve optimum charging efficiency depends upon the radial distance between the surfaces of the electrodes and the axis of the liquid flow, on the longitudinal, or axial location of the adapter with respect to a plane perpendicular to the axis of the adapter and passing through the discharge point of the fluid nozzle, on the rates of air and liquid flow from the nozzle, and the like. Thus, as the induction charging electrodes are moved radially outwardly from the axis of the liquid flow, higher voltages are required to achieve the optimum charging efficiency.

It has been found that optimum results are obtained when the average potential gradient within the charging zone, between the charging electrodes and the fluid nozzle, is between about 5 and about 25 kilovolts per inch. While the preferred embodiment described herein utilizes induction charging electrode means removably connected to the spray gun, it is to be understood that such electrode means can also be an integral fixture of the spray gun.

Returning to FIGS. 2 and 4, the rod 27 in the embodiment shown protrudes forwardly from the tip of the needle 26 and extends forward of the fluid nozzle orifice 25. The rod 27 in the embodiment shown is disposed within the shaft of the needle 26 to protrude forwardly from a forward orifice 29 in said needle 26. The rod 27 can be electrically conductive and grounded, as with a connection wire 43 shown in broken line from the needle shaft to ground plate 44, or it can be electrically non-conductive or dielectric without said connection wire. In either case, however, the rod 27 will be grounded during fluid issue from the fluid nozzle orifice 25 when said rod becomes coated with fluid which is electrically conductive but grounded at ground plate 44. When an electrically non-conductive or dielectric rod is utilized and the fluid through the fluid nozzle orifice 25 is discontinued by allowing the needle 26 of the needle valve assembly to block said fluid nozzle orifice 25, remaining fluid on the rod 27 is swept away by the atomizing gas issuing from the gas nozzle 18, thereby reinstating the non-conductive or dielectric properties of the rod 27 to prevent the possibility of sparking between the rod and the induction electrodes 96,98. Diameter of the rod in relation to diameter of the fluid nozzle orifice can be selected as required in respect to viscosity of fluid being sprayed, fluid flow rate desired, and the like. Generally, the diameter of the portion of the rod disposed within the fluid nozzle orifice will be between about 20 percent and about 70 percent of the diameter of the fluid nozzle orifice, but can be greater or less depending upon actual orifice diameter and physical characteristics of fluid being sprayed. As earlier related, because the rod is electrically grounded at least during fluid issue, the fluid in contact with the rod is very near ground potential, thus providing a maximum potential gradient between the electrode means and the fluid which is then atomized as particles or droplets entering the charging zone to thereby produce maximum droplet charging. Furthermore, the rod acts to provide more surface area from which droplets can be formed, resulting in formation of a greater number of uniformly sized droplets for charging. The maximum potential gradient discussed above, coupled with the greater number of uniform droplets formed, act to distribute the electrical charge more evenly on the assembly of droplets and thereby yield better deposition of fluid particles on the workpiece being coated, said workpiece being understood to be electrically respective to the charged spray.

Figure 4:
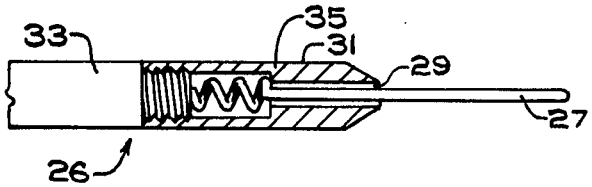
FIG. 4 is an exploded partial sectional view of the needle and rod of FIG. 2.

As is shown in FIG. 4, the rod 27 is secured within the needle 26 by means of a needle tip 31 having an orifice 29 through which the rod 27 extends, with said needle tip 31 threadably securable to the shaft portion 33 of the needle 26. The rearward end of the rod 27 is spiraled and abuts the shaft portion 33 to be held in place with tension against the rear of orifice wall 35. When the spray gun 10 is in operation, the rod 27 must protrude forwardly from the fluid nozzle orifice 25 and can protrude into the charging zone of the electrodes 96,98.

Figure 5:
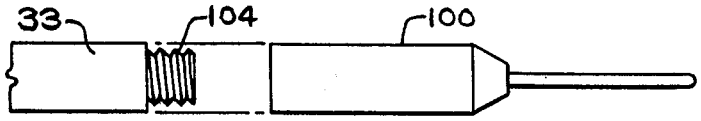
FIG. 5 is an exploded side elevation view of a second embodiment of the needle of a needle valve assembly and a rod for attachment thereto.

FIG. 5 illustrates a second embodiment whereby a rod 100 shown therein can be attached to the shaft 33 of the needle-valve assembly. The rod 100 is threadably securable to receiving threads 104 on the shaft 33, with said rod 100 serving as both the needle end element and the rod element.

Figure 6:
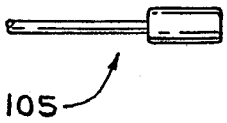
FIG. 6 is an exploded side elevation view of a rod whose tip is cylindrically enlarged.

FIG. 6 shows a variation in rod tip geometry wherein the rod 105 has a tip geometry which is cylindrically enlarged. In this configuration more surface area circumference is present, thereby creating a greater liquid dispersion for exposure to induction charging upon atomization.

Figure 7:
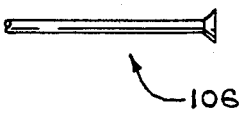
FIG. 7 is an exploded side elevation view of a rod whose tip is inverse-cone shaped.

FIG. 7 illustrates a variation in rod tip geometry which can be employed. In FIG. 7 the rod 106 has a tip geometry in the configuration of an inverse cone. In this geometry the cone shape acts to spread fluid and fluid droplets around the edge of the cone. The geometric expansion of the rod into the inverse cone shape creates a greater surface area which provides greater liquid dispersion for exposure to the induction charging field upon atomization. In the embodiment of both FIGS. 6 and 7, the diameter of the enlarged portions of the respective rods can be less than, equal to, or greater than the diameter of the fluid nozzle orifice.

Figure 8:
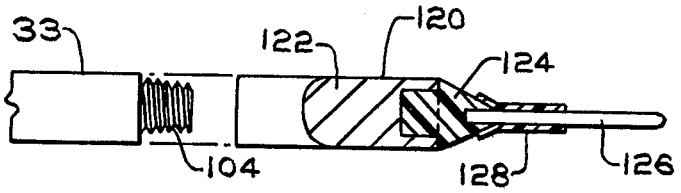
FIG. 8 is an exploded side elevation view of a third embodiment of a rod for attachment to the needle of a needle-valve assembly.

Finally, FIG. 8 illustrates a third embodiment whereby a rod 120 shown therein can be attached to the shaft 33 of the needle-valve assembly. The rod 120 is threadably securable to receiving threads 104 on the shaft 33, with said rod 120 serving as both the needle end element and the rod element. The rod 120 has an electrically conductive base 122 into which a dielectric or electrically non-conductive shoulder portion 124 is press-fit. The conductive distal portion 126 of the rod 120 is press-fit into the said shoulder portion 124. If desired, a small portion of the distal portion 126 can have coated thereon and in contact with the shoulder portion 124 an electrically non-conductive or dielectric material 128 such as a epoxy resin. Such forward extension of electrically non-conductive or dielectric material 128 from the shoulder portion 124 reduces electrically-conductive rod length for enhancement of safety considerations. Operably, fluid issue through the fluid nozzle orifice 25 of the spray gun 10 of FIGS. 1 and 2 can be discontinued by blocking said orifice 25 with the shoulder portion 124. When this occurs, a part of said shoulder portion 124 becomes exteriorly exposed outside the fluid nozzle orifice 25. Remaining fluid on the exposed part of the shoulder portion 124 is swept away and/or dried by the atomizing gas issuing from the gas nozzle 18, thereby reinstating the non-conductive or dielectric properties of the shoulder portion 124 to prevent the possibility of current travel upstream to the spray gun 10.

As is known in the art, the shape of the spray from a spray gun is determined by the direction of the gas issuing from the gas nozzle and its direction of impingement on issuing fluid particles. A preferred embodiment for coating composition applications provides ear elements as shown in FIG. 2 from which gas issues from diametrically opposed orifices to effect a fan-shape spray.

EXAMPLE I

To 3,600 grams of Duracron 200® paint composition (thermosetting acrylic enamel, PPG Industries, Inc.) were added 487 grams of xylene and 422 grams of diacetone alcohol to yield a final paint composition containing 48–49 percent weight solids and approximately 0.1 μmho/cm conductivity. This paint composition was delivered from a pressure pot maintained at 2 psig; the induction charging electrode was powered to a voltage of about +14.5 KV. Spray parameters in the different modes of operation were chosen which deposit a coating at a constant film build (measured dry after baking) per coat on an electrically-grounded flat sheet target which represents a typical industrial-coating application situation. The mass flow ratio (mass of air [total air used in the spray gun] divided by mass of fluid sprayed in a unit time) was held constant at 1.2:1 to provide good atomization and minimize the influence of mechanical atomization variables other than the rod in the experimentation. Parameters for transfer efficiency tests were determined by spraying flat steel panels to a constant dry film thickness of 0.8 mil per coat with an automatic spraying machine.

Targets utilized for measuring transfer efficiency in the Examples herein were constructed according to the following description. Each of five targets used in each measurement of transfer efficiency consisted of a preweighed aluminum foil about 6 inches (15.24 cm) wide, 36 inches (91.44 cm) long, and 0.0015 inch (0.0038 cm) thick. An electrically-grounded frame was provided, and the targets were mounted thereon in the following order. Two of the foil targets were mounted on a flat aluminum plate attached to the frame, thus providing two flat sheet targets. The remaining three foil targets were mounted on U-shaped (when viewed from above) aluminum plates attached to the frame, thus providing three semi-tubular targets. The lateral sides of these targets were about $1\frac{3}{4}$ inches (4.45 cm), while the remaining portion (equivalent to the base of the U-shape) was about $1\frac{1}{8}$ inches (2.85 cm). Distance between the mid-points of said bases of the U-shape plates was 6 inches (15.24 cm). Finally, five tube-shaped (when viewed from above) aluminum foil targets, not involved in transfer efficiency measurements, were provided to the frame to make certain that electrical attraction of charged particles being sprayed toward the targets was not improperly concentrated toward the adjacent semi-tubular target which, but for the tube-shaped target, would be the final target to be sprayed.

In this Example I a Binks Model 70 spray gun equipped with a Binks Model N65 fluid nozzle, modified to have no center rod, and modified to be equipped with a Binks Model N63PB air cap, was utilized. The induction charging adapter of FIG. 3 was attached. The spray gun was stationary and placed so that the targets were 12 inches (30.48 cm) from the face of the air cap. The frame upon which the targets were disposed was passed at a speed of 28 feet (8.53 m) per minute in front of the spray gun. For each set of measurements, four sets of two such passes were made while paint was being sprayed, and average transfer efficiency was determined.

By definition, transfer efficiency (TE), reported as a percentage of coating solids deposited on a target in relation to the theoretical amount (100%) which could be deposited on said target is determined according to the following formula:

$$\% TE = \frac{\text{target speed (ft/min)} \times \text{gms. coating deposited} \times 100}{\text{coating flow (gms/min)} \times \text{target width (ft.)} \times \text{\# passes} \times \text{coating solids (decimal fraction)}}$$

In the above calculation, the designation "target speed" refers to the speed at which the target is passed perpendicularly to the axis of the fluid nozzle of the spray gun. Weight of coating composition is determined after drying. Coating composition flow rate is measured at the spray gun. The term "coating solids" is defined as the decimal fraction of weight solids.

To calculate transfer efficiency, the foils above described were removed from their frames after spraying, baked for 20 minutes at 340° F., cooled to 70° F., and weighed to determine net paint deposition. Measurements were made both with and without induction charging. Results are shown in Table I.

TABLE I

| Induction Charging | Air Pressure (PSIG) Measured at Gun Butt | Paint Flow Rate (g/min.) | % TE Flat Sheet | % TE Semi-Tubular |
|---|---|---|---|---|
| Yes | 28 | 228 | 69.7 | 28.8 |
| No | 41 | 305 | 53.7 | 13.4 |

EXAMPLE II

In the same manner as in Example I, except using the spray gun with a metal grounded rod within the orifice of the fluid nozzle, said rod having a diameter of 0.025 inch (0.0635 cm) and protruding ⅛ inch (0.3175 cm) from the fluid nozzle orifice during spraying, with said orifice having a diameter of 0.059 inch (0.1498 cm), measurements were made both with and without induction charging, as shown in Table II.

TABLE II

| Induction Charging | Air Pressure (PSIG) Measured at Gun Butt | Paint Flow Rate (g/min.) | % TE Flat Sheet | % TE Semi-Tubular |
|---|---|---|---|---|
| Yes | 18 | 169 | 75.7 | 35.7 |
| No | 35 | 272 | 56.6 | 13.6 |

As is apparent, transfer efficiency was signficantly improved where the apparatus of the instant invention was employed.

EXAMPLES III AND IV

Using the same target techniques as in Example II, except with a ½ inch (1.27 cm) diameter circular opening in a flat sheet target behind which was mounted a rapidly moving microscope slide, particle size distribution was determined by microscopic measurement. Table III shows the results.

TABLE III

| Example No. | Conditions | Particle Size Distribution % 0.8–3.2μ | 3.2–5.6 | 5.6–8.0 | 8.0–10.4 | 10.4–12.8 | 12.8–15.2 | 15.2–24.8 | 24.8–46.4 | >46.4 |
|---|---|---|---|---|---|---|---|---|---|---|
| III | Center rod; no induction charging | 0 | 5.49 | 7.93 | 4.88 | 5.49 | 4.47 | 21.34 | 33.33 | 17.07 |
| IV | Center rod; induction charging | 0.38 | 36.86 | 34.08 | 6.38 | 4.48 | 2.10 | 8.38 | 2.76 | 4.57 |

As is seen in Table III, Example IV shows about 70 percent of the particles have a size of 3.2 to 8.0μ where induction charging and the center rod are employed. Particles so sized provide for more uniform charging as well as better deposition quality on a workpiece.

Those skilled in the art will recognize the inventive quanta of this application can be embodied in forms other than those specifically exemplified herein for purposes of illustration.

What is claimed is:

1. A spray gun having a gas nozzle and a fluid nozzle, each of said nozzles being in cooperative spatial relationship with the other to cause a fluid stream issuing from the fluid nozzle to be atomized and sprayed as fluid particles by gas issuing from the gas nozzle, with said spray gun having disposed within the fluid stream means for increasing surface area from which said particles can be formed, said means being electrically grounded at least during fluid issue from the fluid nozzle, and with said spray gun additionally having induction charging electrode means disposed adjacent the gas and fluid nozzles, said electrode means (a) having a rear edge located rearward of a plane which is perpendicular to the axis of liquid flow and which passes through the discharge point of said fluid nozzle and (b) defining a charging zone wherein an electrostatic charge is imparted to atomized electrically chargeable fluid particles.

2. A spray gun as claimed in claim 1 wherein the induction charging electrode means is removably connected to the spray gun.

3. A spray gun as claimed in claim 1 wherein the means for increasing surface area protrudes into the charging zone of the electrode means.

4. A spray gun as claimed in claim 1 wherein the means for increasing surface area is constructed of a material which is electrically conductive and grounded.

5. A spray gun as claimed in claim 1 wherein the means for increasing surface area is constructed of a material which is electrically non-conductive or dielectric.

6. A spray gun as claimed in claim 1 wherein the orifice of the fluid nozzle has therein as means for increasing surface area an axially disposed rod protruding forwardly therefrom, said rod being electrically grounded at least during fluid issue from the nozzle.

7. A spray gun as claimed in claim 6 wherein the rod is secured within the needle of a needle valve assembly and protrudes forwardly therefrom, said needle valve assembly present within the spray gun to control fluid issue through the orifice of the fluid nozzle.

8. A spray gun as claimed in claim 7 wherein the rod is additionally the needle end element.

9. A spray gun as claimed in claim 6 wherein the tip of the rod is inverse-cone shaped.

10. A spray gun as claimed in claim 6 wherein the tip of the rod is cylindrically enlarged.

11. A spray gun as claimed in claim 6 wherein diameter of the portion of the rod disposed within the fluid nozzle orifice is from about 20 percent to about 70 percent of the diameter of the orifice of the fluid nozzle.

* * * * *